United States Patent [19]

Eyman, deceased et al.

[11] 4,195,365

[45] Apr. 1, 1980

[54] GLOVE

[76] Inventors: Glen C. Eyman, deceased, late of Palastine, Tex.; by Dollie H. M. Eyman, administratrix, 1217 N. Link, Palastine, Tex. 75801

[21] Appl. No.: 935,467

[22] Filed: Aug. 21, 1978

Related U.S. Application Data

[63] Continuation-in-part of Ser. No. 763,353, Jan. 28, 1978.

[51] Int. Cl.[2] ..... A41D 19/00; A63B 31/02

[52] U.S. Cl. ..... 2/161 A; 9/308

[58] Field of Search ..... 2/161 A; 9/308

[56] References Cited

U.S. PATENT DOCUMENTS

| | | | |
|---|---|---|---|
| 1,185,411 | 5/1916 | Kennard | 9/308 |
| 1,679,836 | 8/1928 | Linder | 9/308 |
| 3,174,167 | 3/1965 | Pauley | 9/308 |
| 3,938,207 | 2/1976 | Drescher | 9/308 |

*Primary Examiner*—Doris L. Troutman

*Attorney, Agent, or Firm*—Robert D. Farkas

[57] ABSTRACT

A glove that is especially suitable for use in aquatic activity and for sky diving, which includes a glove body having a plurality of finger stalls joined together by a web, apertures at the finger tip portions of the stalls and a plurality of apertures randomly disposed about the glove body surface to provide added comfort and to ease the addition and removal of the glove from the hand.

7 Claims, 3 Drawing Figures

FIG. 1
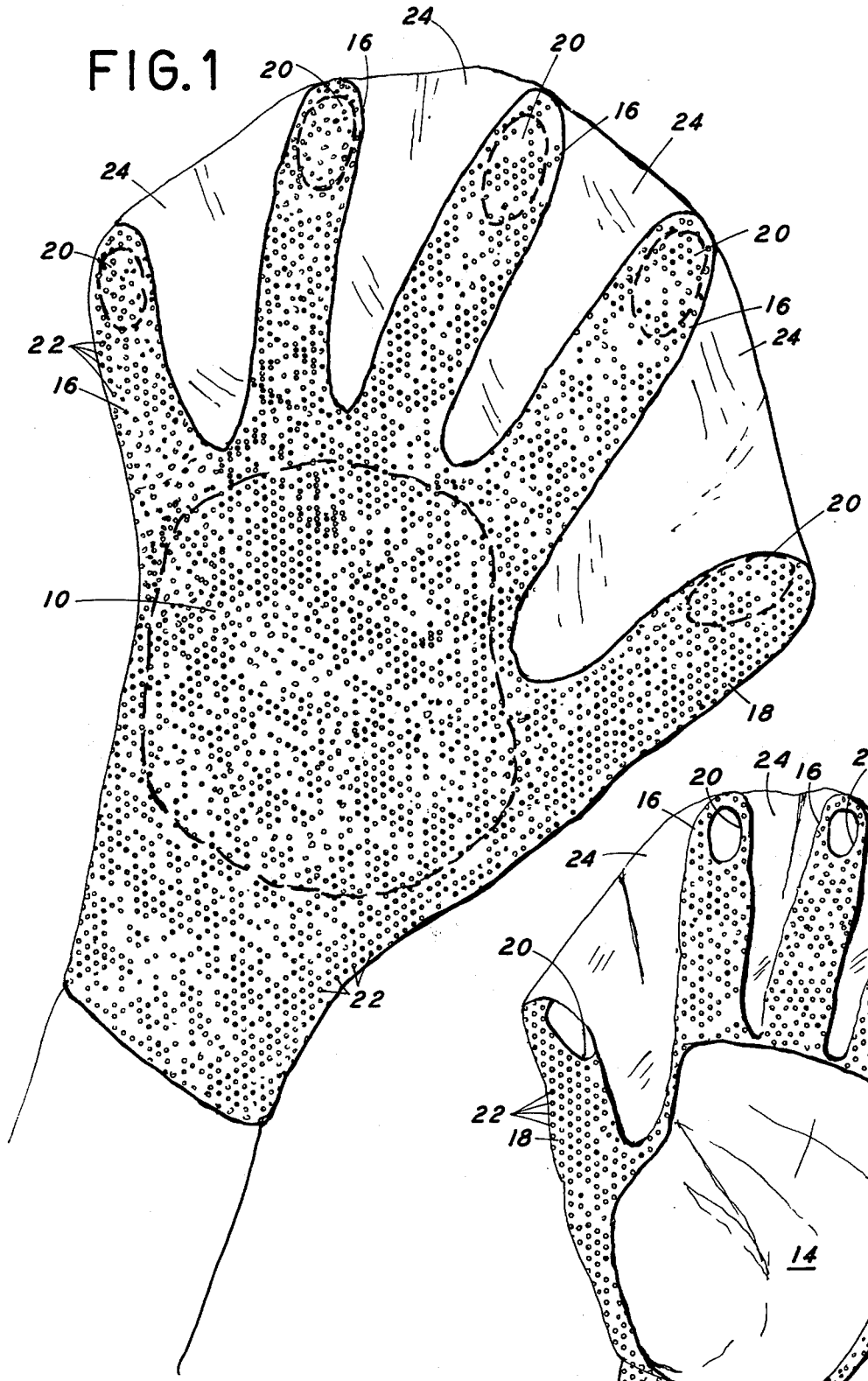
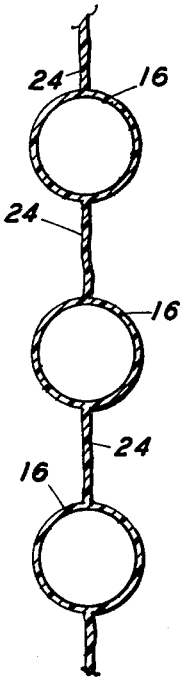
FIG. 3
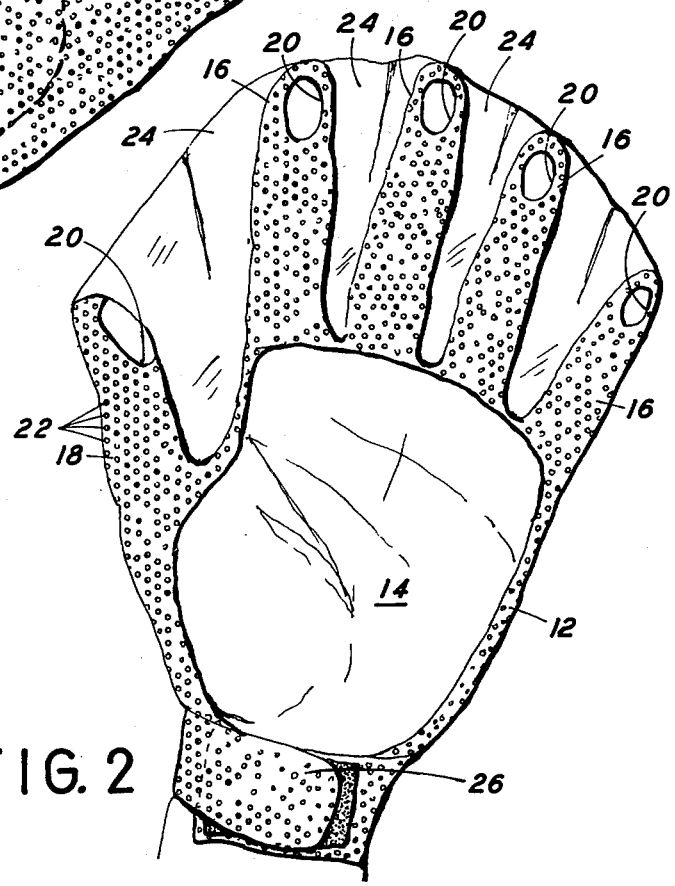
FIG. 2

GLOVE

BACKGROUND OF THE INVENTION

This application is a continuation-in-part of prior U.S. application Ser. No. 763,353, filed Jan. 28, 1978.

This invention relates to a glove, more particularly, to a glove especially adapted to be worn in aquatic activity due to its webbed finger construction, and open finger tip portions thereby providing for maximum tactile sensitivity.

The prior art teaches a variety of webbed gloves, for example, as disclosed in U.S. Pat. Nos. 1,565,005; 1,669,010; 1,679,679; 2,004,684; 2,078,133; 2,324,375, 2,726,410; 3,023,432; 3,938,207 and others.

SUMMARY OF THE INVENTION

It is accordingly an object of the instant invention to provide for a new and improved webbed glove.

It is another object to provide for one having the attributes and characteristics as aforedescribed.

It is a further object to provide for the same at relatively little cost thereby making it generally available.

These and other objects and advantages of the invention will become more apparent from a consideration of the following detailed disclosure and claims and by reference to the accompanying drawings, in which:

FIG. 1 is a rear elevational view;

FIG. 2 is a front elevational; and

FIG. 3 is a sectional view.

Broadly speaking, the instant invention includes the provision of a glove, comprising a glove body having front and back portions and a plurality of hollow tubular finger receiving stalls and a thumb stall, web means communicating between the finger stalls and the thumb stall, each of the finger stalls and the thumb stall defining a first aperture adjacent the distal end of the stall exposing at least a portion of the finger, the glove body defining a plurality of randomly disposed second apertures.

DETAILED DESCRIPTION OF THE PREFERRED EMBODIMENT

Referring more particularly to the drawings, there is shown a hand upon which there is worn the instant glove. The glove includes a glove body having a back portion 10 covering the back side or top of the hand and a front portion 12, covering at least a portion if not all of the palm 14 or front part of the hand. In the preferred embodiment, a cut out or enlarged irregular aperture will be defined in the front portion 12, such that at least a portion of the palm 14 is exposed. The glove body will include four finger stalls 16 and a thumb stall 18 each adapted to receive a finger or thumb, respectively therein. Adjacent the distal end of each stall 16, 18 there will be defined an aperture 20 roughly in axial alignment with the finger tip area thereby providing for maximum retention of tactile sensation in the fingers, handling and lifting items when wearing the instant glove. A plurality of small apertures 22 are randomly dislposed about the front, back and stall portions of the glove, thereby providing for comfort and ease in putting on and removing the glove from the hand. The plurality of apertures 22 serving to release air that is otherwise trapped in the glove when the same is placed upon the hand. A web of flexible material 24 is disposed between each of the finger stalls 16 and the thumb stall 18 and communicates therebetween, all fingers and the thumb being connected. The material of construction of the glove body may be the same as that of the flexible web 24, i.e., plastic, natural or synthetic latex, etc. If desired, a strap means 26 may be provided at the open end of the glove body (that is the end through which the hand is inserted) for fastening the glove body secure about the wrist area. In the later instance, the strap means 26 may be unitary with the glove body and may include "Velcro"fasteners, buckle, etc., or other suitable closure means thereon.

Apertures 20 are disposed having marginal edges 28 surrounding apertures 20. Edge 30, defining aperture 20, is sharpened in shape, defining a ramp-like marginal edge 28, interior surface 34 of stall 16. Similarly, thumb stall 18, has its aperture 20, defining marginal edges 28 terminating at sharpened edge 30, intermediate interior surface 36 and edge 32 disposed between marginal edge 28 and exterior surface 38. In this fashion, a portion of the hand, disposed within stalls 16 and 18, adjacent apertures 20, is permitted to partially extend outwardly from stalls 16 and 18. The thickness of the body of the material defining the glove, in the area of apertures 20, is minimized, and tapered down to the skin of the hand of the user to obtain tactile sensations on contacting objects under the water. Cut out 40 may have its marginal edges defining cut out 40, tapered, in a similar fashion, if desired.

Since it is obvious that numerous changes and modifications can be made in the above-described details without departing from the spirit and nature of the invention, it is to be understood that all such changes and modifications are included within the scope of the invention.

It is claimed:

1. A glove, comprising a glove body having front and back portions and a plurality of hollow tubular finger securing stalls and a thumb stall, web means communicating between said finger stalls and said thumb stall, each of said finger stalls and said thumb stall defining a first aperture adjacent the distal end of said stall exposing at least a portion of said finger, said portion of said finger being intermediate the palm of the hand and the distal most end of said finger, said glove body defining a plurality of randomly disposed second apertures, said first aperture being defined by marginal edges in said each of said finger stalls and said thumb stall, a portion of said marginal edges immediately adjacent said first aperture defining a sharpened edge, said sharpened edge residing in the interior surface of said edge of said finger stalls and said thumb stall, whereby said first aperture maximizes the tactile sensation of said portion of said finger.

2. The glove as defined in claim 1 wherein said web is flexible.

3. The glove as defined in claim 1 wherein said first aperture is in approximate planar alignment with the tip of said finger, wherein said tip of said finger carrying the ball of said finger located adjacent said distal most end of said finger.

4. The glove as defined in claim 1 wherein said front portion defines an enlarged third aperture exposing at least a portion of said palm of the hand.

5. The glove as defined in claim 1 wherein said glove body includes strap means communicating with the open end thereof and being adapted to secure said glove about the wrist of the hand.

6. The glove as defined in claim 5 wherein said strap means is unitary with said glove body.

7. The glove as defined in claim 5 wherein said strap means includes means for fastening said strap about the wrist.

* * * * *